United States Patent [19]

Toups

[11] 4,028,759

[45] June 14, 1977

[54] MARINE ANCHOR BUOYS

[75] Inventor: Earl Lee Toups, Mobile, Ala.

[73] Assignee: Lee Marine, Inc., Kaplan, La.

[22] Filed: Apr. 26, 1976

[21] Appl. No.: 680,505

[30] Foreign Application Priority Data

June 25, 1975 United Kingdom ..... 26889/75

[52] U.S. Cl. ..... 9/8 R

[51] Int. Cl.[2] ..... B63B 21/52

[58] Field of Search ..... 9/8 R; 114/230, 16 R, 114/16 E, 50–52

[56] References Cited

UNITED STATES PATENTS

| | | | |
|---|---|---|---|
| 2,716,959 | 9/1955 | Betts, Jr. et al. | 9/8 R |
| 3,001,371 | 9/1961 | Gilmore, Jr. et al. | 9/8 R |
| 3,276,049 | 10/1966 | Stixrud | 9/8 R |
| 3,512,493 | 5/1970 | Hallanger | 9/8 R |
| 3,660,855 | 5/1972 | Inman | 9/8 R |
| 3,732,588 | 5/1973 | Mitchell | 9/8 R |
| 3,860,983 | 1/1975 | Furth et al. | 114/16 R |

*Primary Examiner*—Trygve M. Blix
*Assistant Examiner*—Stuart M. Goldstein
*Attorney, Agent, or Firm*—Mason, Fenwick & Lawrence

[57] ABSTRACT

A buoy for supporting a cable which is connectible with an anchor, includes at least two buoyancy chambers which can be filled with a flotation medium, one of the buoyancy chambers having a closable inlet and outlet through which fluid can be passed to vary as desired the volume of a flotation medium in the one chamber. The buoy preferably includes a system for guiding the cable and a buoyancy chamber is preferably so mounted on the cable-guiding system as to be longitudinally movable relative thereto, at least one roller assembly being mounted on the cable-guiding system, and including a plurality of freely rotatable rollers which define an opening for passage of a cable therethrough in a substantially friction free manner.

The cable-guiding system preferably comprises a plate having a central opening for passage of the cable and normal to one major surface of which are mounted pairs of parallel cheek plates equally spaced to each side of and parallel to the radiating sections of criss-crossed planes intersecting along an axis normal to and centred on the plate, and rollers mounted on roller shafts supported between the cheek plates of each pair, the axes of the roller shafts being so located and the diameters of the rollers being such that the rollers define a central opening axially aligned with that through the plate and through which the cable can pass.

6 Claims, 5 Drawing Figures

MARINE ANCHOR BUOYS

SUMMARY OF THE INVENTION

This invention is concerned with improvements in or relating to a marine anchor buoy, i.e. a buoy for supporting a cable which is connectible with an anchor.

A primary object of the present invention is to provide a buoy for supporting a cable which is connectible with an anchor, said buoy including at least two buoyancy chambers which can be filled with a flotation mediums one of said buoyance chambers having a closable inlet and outlet through which fluid can be passed to vary as desired the volume of a flotation medium in said one chamber.

A further object of the present invention is to provide a buoy for supporting a cable which is connectible with an anchor, said buoy including means for guiding the cable, a buoyancy chamber so mounted on the cable-guiding means as to be longitudinally movable relative thereto, and at least one roller assembly mounted on the cable-guiding means, the roller assembly including a plurality of freely rotatable rollers, which define an opening for passage of a cable therethrough in a substantially friction free manner. The cable-guiding means may comprise an elongate tubular member and a pair of said roller assemblies are provided, one at each end of the tubular member.

Yet another object of the present invention is to provide cable guiding means comprising a plate having a central opening for passage of the cable and normal to one major surface of which are mounted pairs of paralled cheek plates equally spaced to each side of and parallel to the radiating sections of criss-crossed planes intersecting along an axis normal to an centred on said plate, and rollers mounted on roller shafts supported between the cheek plates of each pair, the axes of the roller shafts being so located and the diameters of the rollers being such that the rollers define a central opening axially aligned with that through the plate and through which the cable can pass.

BRIEF DESCRIPTION OF THE DRAWINGS

An embodiment of the present invention will now be described by way of example, with reference to the accompanying drawings, in which.

DETAILED DESCRIPTION

Figure 1:
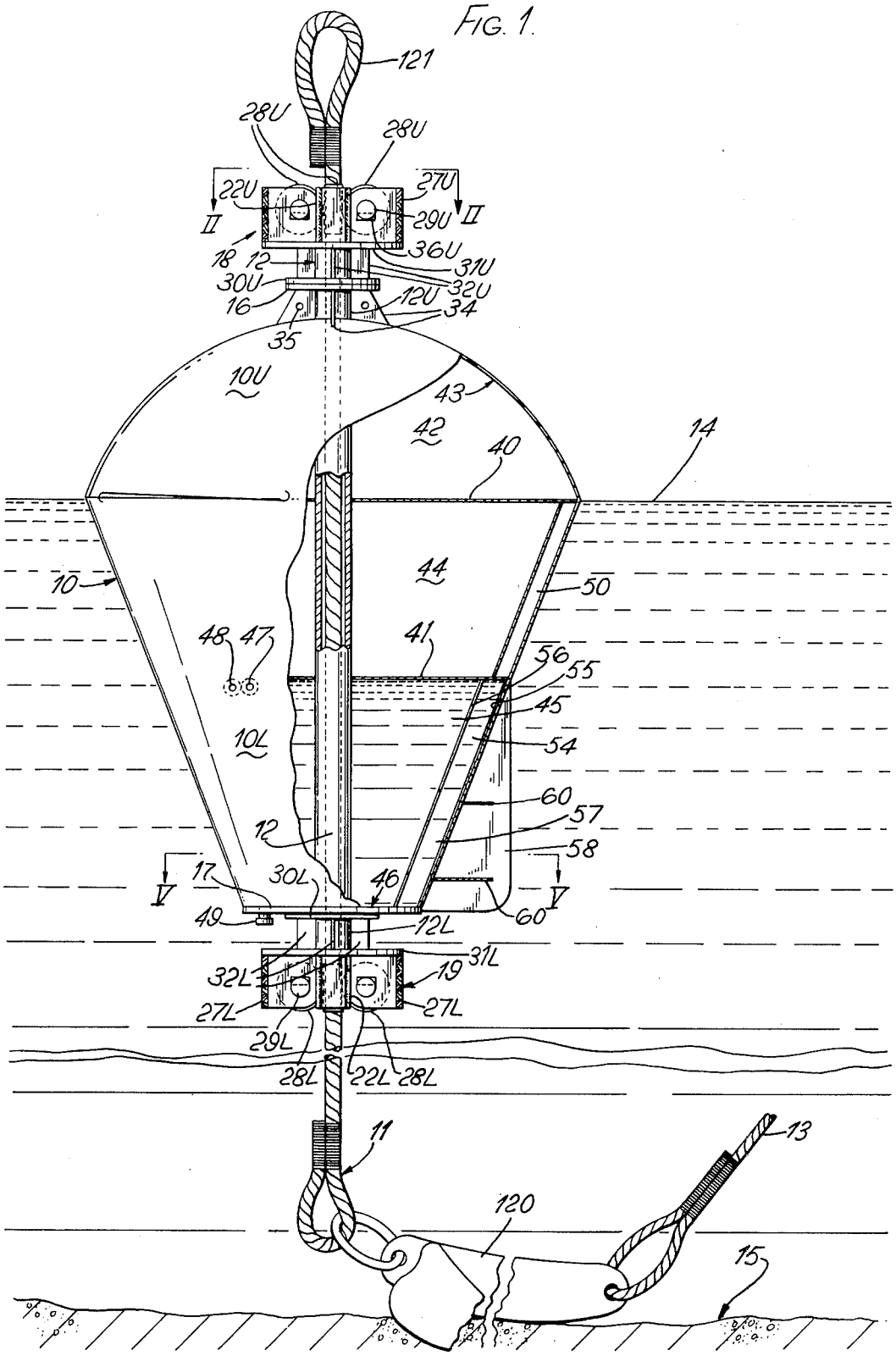
FIG. 1 is an elevation partly in section of a buoy according to the invention with means at the upper and lower ends thereof for supporting and guiding a pinnate cable and showing the buoy in use with the pinnate cable attached to an anchor on a sea-bed.
Figure 2:
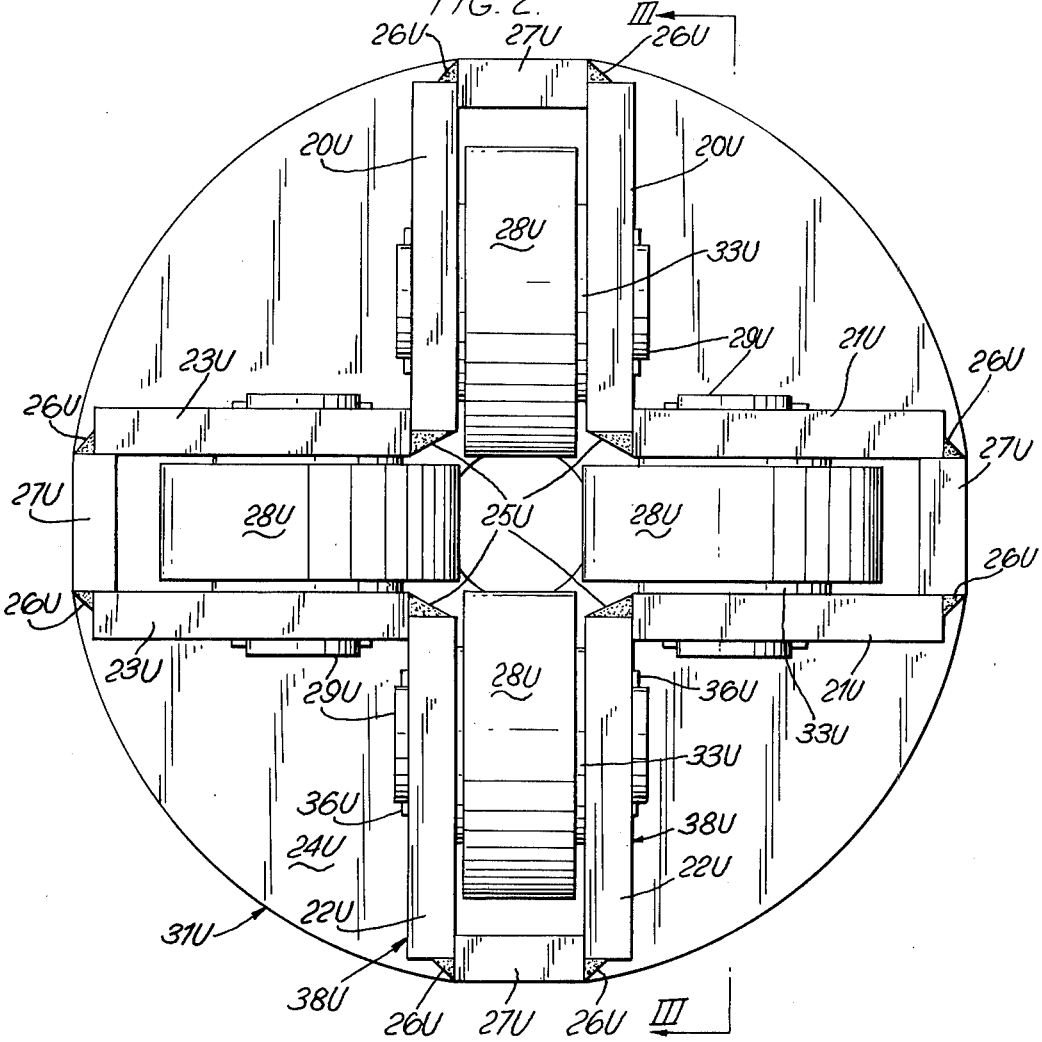
FIG. 2 is a plan view, on a larger scale, of the upper pinnate cable guiding and supporting means, as indicated by the line II — II in FIG. 1.

Referring now to the drawings, a buoy 10 marks the position of and supports a pinnate cable 11 which is connected to a marine anchor 120 from which an anchor cable 13 leads to a marine vessel (not shown). The water surface level is denoted 14 and the sea bed 15 in FIG. 1.

The pinnate cable 11 extends through an elongate tubular member 12 at each end of which is an annular peripheral flange normal to the axis of the member 12. For facility of description the orientation of the buoy 10 will hereinafter be considered to be that when the buoy is operational, as in FIG. 1, and the upper and lower annular peripheral flanges are denoted 16 and 17, respectively.

The flanges 16 and 17 mount upper and lower roller boxes 18 and 19, respectively, which are identical in construction and the parts of which are distinguished from one another herein and in the drawings by the letters U and L, respectively the upper roller bar includes a base plate 31U in the form of a disk-shaped plate spaced in parallel relationship from and co-axial with the flange 16, a short tubular length 12U identical in cross-section with and co-axial with the tubular member 12 extends from the base plate 31U and terminates in an annular flange 30U having therein an annular series of holes 133U through which it is bolted to the flange 16. The base plate 31U and 31L and the annular flanges 30U and 30L have therein central openings which in effect make the short tubular lengths 12U and 12L extensions of the tubular member 12.

The upper roller box 18 includes four pairs of mutually-parallel and spaced cheek plates 20U, 21U, 22U and 23U, respectively, which are part with and normal to the outer surface 24U of the base plate 31U, that is the base plate surface remote from the tubular length 12U. The pairs of cheek plates are equally spaced to each side of and are parallel to the radiating sections of criss-crossed planes intersecting along the axis of the tubular length 12U the cheek plates extending from close to the periphery of the aforesaid surface 24U and stopping short of the central opening in the base plate 31U. The inner ends of adjacent cheek plates are in contact and are welded together as indicated at 25U, and the outer ends of the cheek plates of each pair are welded or indicated at 26U to an end spacer plate 27U disposed between same at the periphery or the surface 24U. A roller 28U is mounted to be freely rotatable on a shaft 29U supported between each pair of cheek plates 20U, 21U, 22U, and 23U, the axes of the roller shafts 29U being so located, and the diameters of the rollers 28U being such, that the rollers 28U define a central opening axially with that of the tubular length 12U. A bushing 39U, for example of teflon (registered trade mark) or brass, is located between the bore in each roller 28U and the surface of the associated shaft 29U to prevent the shaft 29U from galling. A spacer 33U is located between each flank of each roller 28U and the adjacent cheek plate surface. Shaft retainers 36U are engaged in slots 37U therefor adjacent the ends of the shafts 29U and fit flush against the outer surfaces 38U of the cheek plates.

The buoy 10 is centred on the tubular member 12 and comprises a lower part 10L of inverted frusto-conical shape which merges at its upper end with an upper part 10U of the shape of a spherical segment. The lower end of the buoy 10 is closed off by the lower annular peripheral flange 17. Radially-directed spacer plate 32L at 90° intervals about the tubular length 12L extend between the base plate 31L and the annular flange 30L.

The upper end of the buoy 10 is spaced somewhat below the flange 16 and radially-directed spacer plates 34, the outer edges of which diverge in the direction of the buoy 10 and the lower edges of which are shaped to conform to the surface contour of the buoy 10, extend between the flange 16 and the upper end of the buoy 10 and are spaced at 90° intervals about the tubular member 12. The plates 34 have therein eyes 35 through which the buoy 10 can be lifted.

Two transverse baffle plates or diaphragms 40 and 41 divide the interior of the buoy 10 into three compartments, namely an upper compartment 42 between the upper diaphragm 40 and the vaulted upper end 43 of the buoy interior, a middle compartment 44 between the upper and lower diaphragms 40 and 41, and a lower compartment 45 between the lower diaphragm 41 and the inner surface 46 of the flange 17. The upper diaphragm 40 is located where the upper and lower parts 10U and 10L of the buoy 10 merge with one another so that the upper compartment 42 is defined in the spherical segment of the buoy. The two compartment 44 and 45 separated from one another by the diaphragm 41 are of substantially the same volume. An air-escape valve 47 and a water-inlet plug 48 are mounted on the peripheral wall of the buoy 10 closely below the lower diaphragm 41, and a drain plug 49 is provided in the flange 17 defining the bottom wall of the buoy 10.

Figure 5:
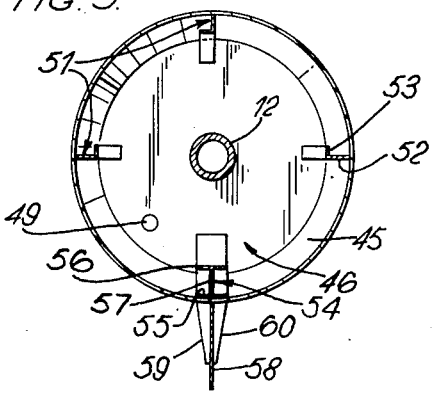
FIG. 5 is a section, on a scale similar FIG. 1, on the line V — V of FIG. 1.
Figure 3:
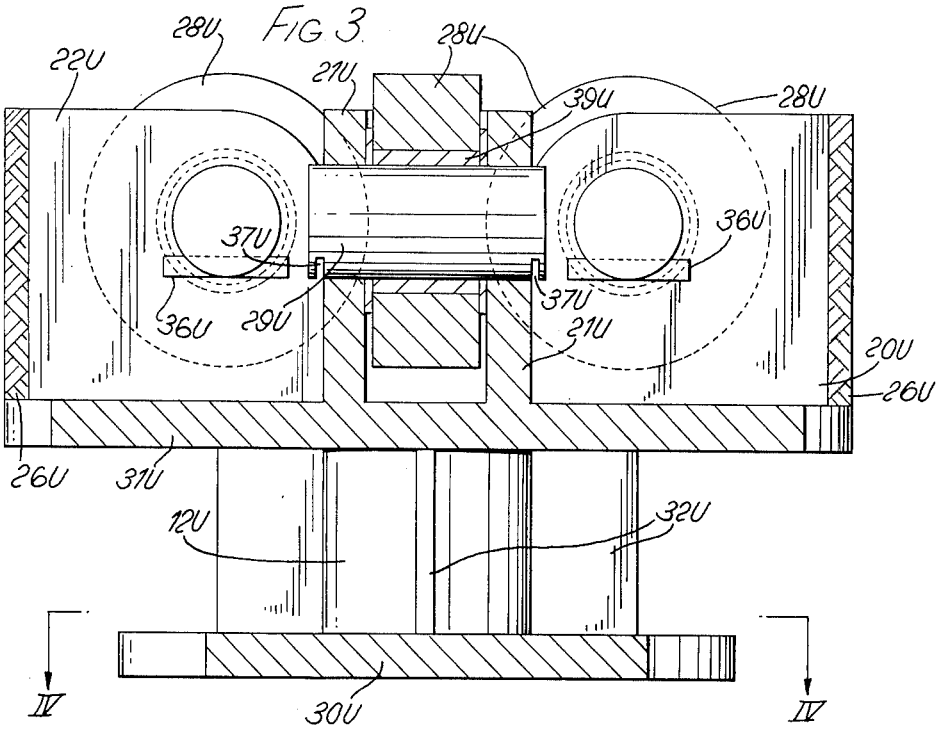
FIG. 3. is a section through the upper pinnate cable guiding and supporting means, the section being on the line III — III of FIG. 2.
Figure 4:
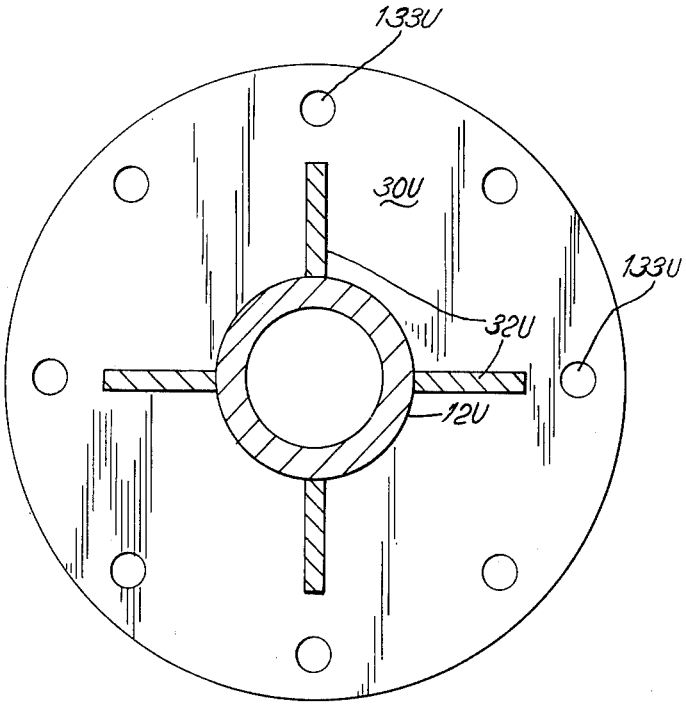
FIG. 4 is a section on the line IV — IV of FIG. 3.

Longitudinal L-shaped ribs 50 and 51 and an I-section rib 54 are secured to the internal wall of the lower part 10L of the buoy 10, the ribs 50 extending throughout the height or depth of the middle compartment 44 and the ribs 51 and the rib 54 extending throughout the height or depth of the lower compartment 45. The ribs in the two compartments are in alignment and are at 90° intervals about the internal wall surface of the lower part 10L of the buoy. As can be seen especially in FIG. 5, the ribs 51 are secured to the internal wall surface of the buoy at the free edge of one web 52 and the other web 53 is spaced from and substantially parallel to said internal wall surface. The rib 54 is secured by one of its webs, denoted 55 to the internal wall surface of the lower compartment 45 of the buoy 10, with the other web 56 spaced by the stem 57 from said internal wall surface in substantially parallel relationship. The ribs 50, 51 and 54 serve to rigidify the lower part 10L of the buoy, and the relatively stronger rib 54 additionally provides support for a stabiliser fin 58 which extends the full height or depth of the lower compartment 45 of the buoy 10 and is secured to the outer wall surface of the buoy directly opposite the rib 54 on the internal wall surface. The fin 58 is substantially of the shape of a right-angled triangle which is rounded at the locus of the right angle and the hypotenuse of which is snug against the outer wall surface of the buoy 10 directly opposite the stem 57 of the I-section rib 54. The fin 58 is rigidified by bracing elements 59 and 60 located directly opposite one another on the opposite sides of the fin 58, the dispositions of the bracing elements 59 and 60 being such that they are horizontal when the buoy 10 is vertical. The shape in plan view of the bracing elements 59 and 60 is evident in FIG. 5 and it can be seen that each taper from a maximum width equal to that of the opposed part of the web 55 to a minimum width in the outwards direction and stop short of the upright free edge of the fin 58. The purpose of the fin 58 is to prevent rotation of the buoy 10 and thus prevent consequent twisting with possible breakage of the pinnate cable 11.

In use of the buoy 10, the pinnate cable after being passed down through the central opening in the upper roller box 18, through the length of the composite tubular member 12U, 12, 12L, and through the central opening in the lower roller box 19, is attached to the anchor 120 of the marine vessel (not shown).

The anchor 120 is attached by a further cable 13 to the marine vessel which carries out operations on the sea bed, and the vessel pays out the anchor cable 13 during its operations until all the cable 13 is utilized. It is then necessary to raise the anchor 120, for re-location, by means of the buoy 10 according to the invention, which marks the position of the anchor 120 and also allows the anchor 120 to be raised as hereinafter described. The pinnate cable 11 is provided with a lifting loop 121 at its upper end and is thereby prevented from passing completely through the buoy 10. The length of pinnate cable 11 used is dependent on the depth of water at the location in which the buoy 10 is to be used.

When in the water, the floating buoy 10 does not rotate but is free to move up and down in conformity with the movement of the surrounding water. Also, the buoy 10 is moved by the water, the pinnate cable 11 moves against the freely rotatable rollers of the roller boxes 18 and 19 in a substantially friction-free manner. The pinnate cable 11 is therefore subject to less wear and breakage than in conventional buoys and is thus longer lasting with consequent savings in costs. The rollers 28U and 28L and their support shafts 29U and 29L are made as large in diameter as is convenient.

The buoyancy of the buoy 10 is dependent on the depth of water in which the buoy 10 and pinnate cable 11 are to be used, the consequent length of pinnate cable 11, and the weight and diameter of cable. In general terms, the deeper the water and therefore the greater the length of pinnate cable 11, the greater is the drag on the buoy 10 and therefore the greater is the required buoyancy. The buoyancy of the buoy 10 according to the invention can be varied to suit differing conditions and locations.

For example, in water, say 100 feet in depth, it is convenient to have a flotation medium, e.g. air, in a volume equivalent to that of the upper and middle compartments 42 and 44 only. In such a case, water is passed into the lower compartment 45 through the inlet plug 48 and the air in the lower compartment is expelled through the air-escape valve 47. In water, say, 550 feet in depth, however, it is necessary to increase the buoyancy from the suitable for 100 foot depths, and in this case the water is drained from the lower compartment 45 through the drain plug 49.

It is envisaged that the upper and middle compartments 42 and 44 may be filled with a flotation medium which solidifies so as to maintain the buoyancy in the event of a puncture in the wall of the buoy 10.

The present invention is not restricted to a buoy used for any particular purpose.

1. A buoy for supporting a varying length of cable connectable with an anchor, comprising a buoyancy chamber for containing a flotation medium to float the buoy, means for replacing at least a portion of said buoyancy medium with a heavier medium thereby permitting the buoy to float at a predetermined desired height above the surface of a body of water regardless of the length of cable being supported, the varying length of the cable being supported by the buoy being dependent upon the predetermined height, cable guiding means mounted on said buoyancy chamber for permitting movement of said cable relative to said buoyancy chamber and at least one roller assembly mounted on said cable guiding means, said roller assembly mounted on said cable guiding means, said roller assembly including a plurality of freely rotatable rollers defining an opening for passage of the cable therethrough in a substantially friction free manner.

2. The buoy of claim 1 wherein the cable guiding means includes an elongated tubular member and a second roller assembly with the roller assemblies mounted on opposite ends of said tubular member.

3. The buoy of claim 2 wherein the buoyancy chamber is centered on said tubular member and wherein said opening for passage of said cable is axially aligned with said tubular member.

4. The buoy of claim 1 including a stabilizer fin mounted externally of the buoy chamber thereby preventing rotation of the buoy when afloat with consequent twisting and possible breakage of the cable.

5. The buoy of claim 1 wherein the buoyancy chamber is divided into upper, middle and lower compartments by upper and lower transverse diaphragms and additionally includes a flotation medium escape valve and an inlet valve for said heavier medium with said valves mounted on said chamber and opening into said chamber below the lower diaphragm thereby permitting removal or addition of the flotation medium or the heavier medium to achieve the desired level of flotation.

6. The buoy of claim 5 wherein the flotation medium is air and the heavier medium is water.

* * * * *